US008252502B2

(12) United States Patent
Tomita

(10) Patent No.: US 8,252,502 B2
(45) Date of Patent: Aug. 28, 2012

(54) METHOD FOR PRODUCING TONER AND RESULTING TONER

(75) Inventor: Masami Tomita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 940 days.

(21) Appl. No.: 11/854,056

(22) Filed: Sep. 12, 2007

(65) Prior Publication Data

US 2008/0063964 A1 Mar. 13, 2008

(30) Foreign Application Priority Data

Sep. 13, 2006 (JP) ..... 2006-247597

(51) Int. Cl.
*G03G 9/113* (2006.01)

(52) U.S. Cl. ..... 430/137.2; 430/137.18

(58) Field of Classification Search ..... 430/130.18, 430/130.2, 137.18, 137.2
See application file for complete search history.

(56) References Cited

U.S. PATENT DOCUMENTS

| | | | | |
|---|---|---|---|---|
| 2,297,691 | A | 10/1942 | Carlson | |
| 6,326,119 | B1 * | 12/2001 | Hollenbaugh et al. | 430/137.2 |
| 2005/0089785 | A1 * | 4/2005 | Chiba et al. | 430/106.1 |
| 2006/0093942 | A1 * | 5/2006 | Eida | 430/108.7 |
| 2006/0177756 | A1 * | 8/2006 | Sugimoto et al. | 430/109.1 |

FOREIGN PATENT DOCUMENTS

| | | |
|---|---|---|
| JP | 42-23910 | 11/1942 |
| JP | 43-24748 | 10/1943 |
| JP | 53-58244 | 5/1978 |
| JP | 2-89064 | 3/1990 |
| JP | 7-104511 | 4/1995 |
| JP | 8-248678 | 9/1996 |
| JP | 10-268569 | 10/1998 |
| JP | 2877476 | 1/1999 |
| JP | 2001-305781 | 11/2001 |
| JP | 2005-196142 | 7/2005 |
| JP | 2005-326840 | 11/2005 |
| JP | 2005-326841 | 11/2005 |
| JP | 2005-326842 | 11/2005 |
| JP | 2006-126587 | 5/2006 |
| JP | 3805220 | 5/2006 |
| JP | 2006-313323 | 11/2006 |

* cited by examiner

*Primary Examiner* — Peter Vajda
(74) *Attorney, Agent, or Firm* — Oblon, Spivak, McClelland, Maier & Neustadt, L.L.P.

(57) ABSTRACT

A method for producing a toner is provided that comprises a kneading step, a milling step, a pre-externally adding step, in which at least a part of an external additive is externally added to the powder to prepare a mixture, a classifying step, a recycle step, and a post-externally adding step, wherein the internally added amount X of the external additive in the toner is regulated within a range of 0.2 part by mass to 3.0 parts by mass based on 100 parts by mass of the toner base.

5 Claims, No Drawings

METHOD FOR PRODUCING TONER AND RESULTING TONER

BACKGROUND OF THE INVENTION

1. Field of the Invention

The present invention relates to a toner suited to develop electrostatic images in image forming processes such as electrophotographic, electrostatic recording, and electrostatic printing processes, and a method for producing the toner.

2. Description of the Related Art

In conventional electrophotographic processes, electrostatic latent images are typically formed on photoconductors by various ways using photoconductive materials in photoconductive layers. The latent images are developed using toners, the toner images are optionally transferred onto recording media such as papers, and the toner images are fixed by means of heating, pressing, heating-pressing, or solvent vapor, thereby to produce copies (see U.S. Pat. No. 2,297,691, Japanese Patent Application Publication (JP-B) Nos. 42-23910 and 43-24748).

The toners are typically constructed from toner base particles that contain a binder resin, a colorant, and a charge control agent, and also an external additive such as silica that is deposited on the surface of the toner base particles in order to improve flowability etc.

The toners may be produced by a milling process, in which toner ingredients such as a binder, a colorant, and a charge control agent are mixed and kneaded, followed by cooling, milling and classifying to prepare base particles, then an external additive is mixed and deposited on the surface of the toner base particles.

The toners may also be produced by a milling process, in which a small amount of external additive is included into the toner ingredients before the milling and the classifying steps, then the milling and the classifying steps are carried out.

The methods to add the external additive in the milling step are disclosed in Japanese Patent Application Laid-Open (JP-A) Nos. 2005-326840, 2005-326841, 2005-326842 and 2006-126587. However, the external additive tends to be embedded into the surface of toner particles in the milling step, therefore, a relatively large amount of the external additive is typically required for assuring its effect, but the relatively large amount of external additive may sometimes cause undesirable phenomena due to the relatively large amount of external additive migrating from the surface at the developing step.

The external additive may also be added before the classifying step, as disclosed in JP-A Nos. 53-58244, 07-104511 and 08-248678. These methods may take an advantage of appropriate classifying ability by virtue of improved toner-flow ability at the classifying step. The component having particle diameters (course particles or fine particles) out of a pre-determined range is recycled into a mixing-kneading step in general for the purpose of resource saving.

When these steps are combined such that an external additive is added before the classifying step and the fine particle component out of the pre-determined range at the classifying step is recycled into the mixing-kneading step; however, there arises such a problem that mixing-kneading torque increases undesirably and the milling ability comes to inadequate at the milling step, since the external additive exists within the recycled toner and the external additive is included in the mixing-kneading step. There may also arise such a problem that the external additive to improve flowability tends to migrate from the surface of toner, deposit on the surface of photoconductors during long-term use, which often acing as nuclei for toner filming.

In toner milling-production methods in which an external additive is added during a classifying step and recycling a particle component out of a pre-determined diameter range into a kneading step, there typically arises such a problem that the filler effect of toner component is likely to be excessive, which deteriorates or increases torque load in the kneading step, and also filming tends to generate on photoconductors.

BRIEF SUMMARY OF THE INVENTION

The present invention aims to provide a method for producing a toner comprising such a process that an external additive is included, classification is carried out, and a fine powder component out of a pre-determined particle diameter distribution is recycled, in which overload or increase of torque at the kneading step may be suppressed, deterioration of milling ability or raise of hardness may be avoided at the milling step, filmings are far from occurring on photoconductors, and charging ability and flowability are stable even under prolonged usage, and also to provide a toner produced by the method.

The present inventors have investigated vigorously to solve the problems in the art described above, and have found that the object of the present invention may be attained by a method for producing a toner that comprises a kneading step, in which toner ingredients are kneaded to prepare a toner composition that comprises a binder resin, a milling step, in which the toner composition is milled to prepare a powder, a pre-externally adding step, in which at least a part of an external additive is externally added to the powder to prepare a mixture, a classifying step, in which the mixture is classified to separate a fine powder component out of a pre-determined particle diameter distribution, a recycle step, in which the fine powder component is recycled into the kneading step, and a post-externally adding step, in which an external additive is added to the toner base, within a pre-determined particle diameter distribution, prepared in the classifying step, wherein the internally added amount X of the external additive in the toner is regulated within a range of 0.2 part by mass to 3.0 parts by mass based on 100 parts by mass of the toner base.

In the toner producing methods of milling type where an external additive is added at a classification step and a fine powder component out of a pre-determined particle size is recycled and kneaded, the component of the external additive is substantially further added (internally added) within the toner. When the external additive such as silica is excessively internally added, the external additive may represent a filler effect on the binder resin in the toner; and as the recycle times increase, the filler effect in the toner composition to be milled tends to be undesirably excessive. Therefore, when the external additive is included at the classifying step, fine powder generated at the subsequent step is typically discarded in conventional processes.

In accordance with the inventive method for producing a toner, the amount of external additive in fine powder to recycle at the kneading step and the amount of external additive at the classifying are controlled, thereby the amount of external additive may be regulated under repeating recycles, and the toner quality may be assured and the resulting toner may be available without discarding fine particles at the classifying step.

The object described above may be solved by the present invention as follows:

A method for producing a toner, comprising a kneading step, in which toner ingredients are kneaded to prepare a toner composition that comprises a binder resin, a milling step, in which the toner composition is milled to prepare a powder, a pre-externally adding step, in which at least a part of an external additive is externally added to the powder to prepare a mixture, a classifying step, in which the mixture is classified to separate a fine powder component out of a pre-determined particle diameter distribution, a recycle step, in which the fine powder component is recycled into the kneading step, and a post-externally adding step, in which an external additive is added to the toner base, within a pre-determined particle diameter distribution, prepared in the classifying step, wherein the internally added amount X of the external additive in the toner is regulated within a range of 0.2 part by mass to 3.0 parts by mass based on 100 parts by mass of the toner base.

Preferably, the internally added amount X of the external additive in the toner is controlled by the amount A of the external additive in the pre-externally adding step and the ratio B between the amount of the fine powder component and the amount of the toner composition without recycled fine powder component in the recycle step (i.e. ratio B=recycled fine powder component/(recycled fine powder component+toner composition without recycled fine powder component)).

Preferably, the amount A of the external additive in the pre-externally adding step, and the ratio B between the amount of the fine powder component in the recycle step and the amount of the toner composition without recycled fine powder component (i.e. ratio B=recycled fine powder component/(recycled fine powder component+toner composition without recycled fine powder component)) satisfy the relation expressed by Equations (1), (2) and (3).

$$0.2 \leqq A \leqq 4.5 \quad (1)$$

$$0.1 \leqq B \leqq 0.3 \quad (2)$$

$$-0.5B+1.8 \leqq A \leqq -2.5B+9.5 \quad (3)$$

Preferably, the amount A and the ratio B are constant in relation to recycle times, and the internally added amount X of the external additive converges to a certain level.

Preferably the amount A and the ratio B are variable in relation to recycle times, and are selected so as to regulate the internally added amount X of the external additive within a range of 0.2 part by mass to 3.0 parts by mass based on 100 parts by mass of the toner ingredients, excepting the externally added amount of the external additive.

In another aspect, the present invention provides a toner as follows:

A toner, produced by a method for producing a toner, comprising a kneading step, in which toner ingredients are kneaded to prepare a toner composition that comprises a binder resin, a milling step, in which the toner composition is milled to prepare a powder, a pre-externally adding step, in which at least a part of an external additive is externally added to the powder to prepare a mixture, a classifying step, in which the mixture is classified to separate a fine powder component out of a pre-determined particle diameter distribution, a recycle step, in which the fine powder component is recycled into the kneading step, and a post-externally adding step, in which an external additive is added to the toner base, within a pre-determined particle diameter distribution, prepared in the classifying step, wherein the internally added amount X of the external additive in the toner is regulated within a range of 0.2 part by mass to 3.0 parts by mass based on 100 parts by mass of the toner base.

DETAILED DESCRIPTION OF THE INVENTION

Toner Producing Method and Toner

The inventive method for producing a toner comprises a kneading step, in which toner ingredients are kneaded to prepare a toner composition that comprises a binder resin, a milling step, in which the toner composition is milled to prepare a powder, a pre-externally adding step, in which at least a part of an external additive is externally added to the powder to prepare a mixture, a classifying step, in which the mixture is classified to separate a fine powder component out of a pre-determined particle diameter distribution, a recycle step, in which the fine powder component is recycled into the kneading step, and a post-externally adding step, in which an external additive is added to the toner base, within a pre-determined particle diameter distribution, prepared in the classifying step, and also other steps as required.

The inventive toner may be produced by the inventive method for producing a toner. The inventive toner will be apparent through explaining the inventive method for producing a toner in the following.

In accordance with the present invention, the internally added amount X of the external additive in the toner is regulated by way of controlling the externally added amount A of the external additive in the pre-externally adding step and the ratio B between the amount of the fine powder component and the amount of the toner composition without recycled fine powder component in the recycle step (i.e. ratio B=recycled fine powder component/(recycled fine powder component+toner composition without recycled fine powder component)).

The internally added amount X of the external additive is regulated within a range of 0.2 part by mass to 3.0 parts by mass based on 100 parts by mass of the toner base, from the view points of torque-up at the kneading step, milling ability at the milling step, and stable quality at developing.

When the internally added amount X of the external additive is less than 0.2 part by mass, the external additive for improving the toner flowability tends to be buried in the toner by the effect of stirring at the developing step, and charging ability or flowability of developers often fluctuates under prolonged usage.

On the other hand, when the internally added amount X of the external additive is more than 3.0 parts by mass, higher torque may be necessary, kneading and dispersion may be insufficient, and/or the toner may be insufficient in milling ability since the toner itself comes to harder by action of the internally added filler. Furthermore, the external additive for improving the toner flowability easily separates from the toner surface and may adhere to the surface of photoconductors under prolonged usage, which sometimes acts as nuclei from which filmings easily occur.

The internally added amount X of the external additive varies inevitably with time since the recycling step is employed; in this connection, it is preferred that the range described above is adjusted by controlling the internally added amount A of the external additive partially added in the internally adding step and the ratio B between the amount of the fine powder component and the amount of the toner composition without recycled fine powder component in the recycle step (i.e. ratio B=recycled fine powder component/

(recycled fine powder component+toner composition without recycled fine powder component)).

Preferably, the values A and B are arranged to satisfy the following relation so as to stably regulate the internally added amount of the external additive within a range of 0.2 part by mass to 3.0 parts by mass based on 100 parts by mass of the toner base.

$$0.2 \leqq A \leqq 4.5 \quad (1)$$

$$0.1 \leqq B \leqq 0.3 \quad (2)$$

$$-0.5B+1.8 \leqq A \leqq -2.5B+9.5 \quad (3)$$

Equation (1) defines the range of A, Equation (2) defines the range of B, and Equation (3) defines the relation of A and B. The recycled fine powder component may unexpectedly affect the total of the internally added amount; i.e., when the external additive is added to a certain toner material and fine powder is separated similarly as the classifying step, the amount of the fine powder may be more than twice of the loaded amount of the external additive, which is derived from the fact that the fine powder has a specific surface area higher than that of the external additive.

When the amount A of the external additive partially added in the internally adding step is less than 0.2 part by mass, the external additive for improving the toner flowability tends to be buried in the toner by the effect of stirring at the developing step, and charging ability or flowability of developers often fluctuates under prolonged usage.

On the other hand, when the amount A of the external additive is more than 4.5 parts by mass, higher torque may be necessary, kneading and dispersion may be insufficient, and/or the toner may be insufficient in milling ability since the toner itself comes to harder by action of the internally added filler. Furthermore, the external additive mixed at the subsequent step for improving the toner flowability easily separates from the toner surface and may adhere to the surface of photoconductors under prolonged usage, which sometimes acts as nuclei from which filmings easily occur.

When the ratio B between the amount of the fine powder component and the amount of the toner composition without recycled fine powder component in the recycle step (i.e. ratio B=recycled fine powder component/(recycled fine powder component+toner composition without recycled fine powder component)) is less than 0.1, the external additive for improving the toner flowability tends to be buried in the toner by the effect of stirring at the developing step, and charging ability or flowability of developers often fluctuates under prolonged usage.

On the other hand, when the ratio B is above 0.3, higher torque may be necessary, kneading and dispersion may be insufficient, and/or the toner may be insufficient in milling ability since the toner itself comes to harder by action of the internally added filler.

When A is less or lower than −0.5B+1.8, the external additive for improving the toner flowability tends to be buried in the toner by the effect of stirring at the developing step, and charging ability or flowability of developers often fluctuates under prolonged usage. On the other hand, when A is more than or higher than −2.5B+9.5, higher torque may be necessary, kneading and dispersion may be insufficient, and/or the toner may be insufficient in milling ability since the toner itself comes to harder by action of the internally added filler.

The toner productivity may be stable and the toner may be produced with stable charging ability and flowability even under prolonged usage by the producing method, when the amount A and the ratio B are constant in relation to recycle times, and the internally added amount X of the external additive converges to a certain level.

In addition, the toner productivity may be stable and the toner may be produced with stable charging ability and flowability even under prolonged usage by the producing method, when the amount A and the ratio B are variable in relation to recycle times, and are selected so as to regulate the internally added amount X of the external additive within a range of 0.2 part by mass to 3.0 parts by mass based on 100 parts by mass of the toner base.

The external additive used for the toner according to the present invention may be properly selected depending on the application; preferably, the external additive is an inorganic oxide.

Examples of the inorganic oxides include silica, titania, alumina, zinc oxide, magnesium oxide, cerium oxide, iron oxide, copper oxide and tin oxide. These may be used alone or in combination of two or more. Among these, silica, titania and alumina are particularly preferable in view of charging ability and flowability. The size of the inorganic oxide is preferably 5 to 200 nm as regards the average particle diameter, more preferably 10 to 150 nm. Organic fine particles such as resin fine particles may also be used as required.

The inorganic fine particles for the external additive may be hydrophobically surface-treated. The process for hydrophobic-treatment may be properly selected depending on the application; examples of the hydrophobic-treatment agent include silane coupling agents such as hexamethylenedisilazane (HMDS) and dimethyldichlorosilane (DMDS); and silicone oil treatment agents such as dimethylsilicone oil and amino-modified silicone oil. Among these, silane coupling agents are particularly preferable. The treatment amount of the hydrophobic-treatment agent is preferably 2 to 6 $mg/m^2$ as regards the surface area of the inorganic fine particles.

As described above, the toner producing method according to the present invention comprises the following steps:

(i) a kneading step, in which toner ingredients are kneaded to prepare a toner composition that comprises a binder resin, (ii) a milling step, in which the toner composition is milled to prepare a powder (coarsely milling and finely milling), (iii) a pre-externally adding step, in which at least a part of an external additive is internally added to the powder to prepare a mixture, (iv) a classifying step, in which the mixture is classified to separate a fine powder component out of a pre-determined particle diameter distribution, (v) a recycle step, in which the fine powder component is recycled into the kneading step, and (vi) a post-externally adding step, in which the external additive (residual amount) is added to the component of a pre-determined particle diameter distribution.

In the kneading step (i), preferably, the raw materials such as a binder resin, a colorant and a releasing agent are preliminarily mixed using a Henschel mixer etc., and then the mixture is melted and kneaded. The mixing and kneading of the raw materials may be carried out using conventional kneaders such as closed kneaders, mono-axial or twin-axial extruders and open-roll kneaders in accordance with conventional manners.

In the milling step (ii), in which the toner composition is milled to prepare a powder, the average particle diameter of the coarsely milling is preferably 0.03 to 4 mm, in particular 0.1 to 2 mm, in which the average particle diameter of the coarsely milling refers to the average of the longest lengths of projected areas observed by a microscope.

The milling machines for coarsely milling are exemplified by atomizers and Rootplex etc. Then the powder is finely milled using jet-mills such as collision plate mills and rotary mechanical mills.

The air pressure for milling in jet mills, i.e. the pressure at milling nozzles is preferably 0.2 to 1.0 MPa, more preferably 0.3 to 0.8 MPa.

The mass average particle diameter of the milled product is preferably 2 to 10 μm in view of image quality, more preferably 2 to 7 μm.

In the pre-externally adding step (iii), in which a part of an external additive is internally added before the classifying step, at least a part of the external additive may be included to the milled powder using mixing machines suited to high-velocity stirring such as Henschel mixers and super mixers.

In the classifying step (iv), the mixture is classified to separate a fine powder component thereby to prepare a toner. The classifying devices for the classifying are exemplified by pneumatic classifiers, inertia classifiers, rotor classifiers and sieve classifiers.

In the recycle step (v), in which the fine powder component is recycled into the kneading step, the fine powder component separated at the classifying step is recycled into the kneading step.

In the post-externally adding step (vi), in which the external additive (residual amount) is added to the powder component of a pre-determined particle diameter distribution, at least a part of the external additive may be included to the powder using mixing machines suited to high-velocity stirring such as Henschel mixers and super mixers, similarly as the pre-externally adding step (iii).

The inventive toner comprises a binder resin, a colorant, and other ingredients as required, in addition to the external additive.

Binder Resin

The binder resin may be properly selected depending on the application; examples thereof include polyester resins, styrene-acryl resins, mixtures of polyester resins and styrene-acryl resins, and hybrid resins containing two or more resin components. Among these, polyester resins are particularly preferable in view of colorant-dispersibility and transparency.

The content of the polyester resin is preferably 50 to 100% by mass in the binder resin, more preferably 70 to 100% by mass.

Preferable examples of the hybrid resins are those having a partial chemical bond between polycondensation resins such as polyester resins, polyester-polyamide and polyamide and addition polymerization resins such as vinyl-polymerization resins. The hybrid resins may be prepared from two or more resins or from mixtures of a resin and a raw monomer of other resins, preferably, from raw monomers of two or more species of resins in view of high efficiency to produce hybrid resins.

The raw monomers of the polyester resin may be properly selected depending on the application; alcohol components and carboxylic acid components such as carboxylic acid anhydrides and carboxylic acid esters are typically employed.

Examples of the alcohol components include alkylene (carbon number: 2 to 3) oxide adducts (average added mole number: 1 to 16) of bisphenol A such as polyoxypropylene (2.2)-2,2-bis(4-hydroxyphenyl)propane and polyoxyethylene(2.2)-2,2-bis(4-hydroxyphenyl)propane; and ethylene glycol, propylene glycol, glycerin, pentaerythritol, trimethylolpropane, hydrogenated bisphenol A, sorbitol, and alkylene (carbon number: 2 to 4) oxide adducts (average added mole number: 1 to 16) thereof.

Examples of the carboxylic acid component include dicarboxylic acids such as phthalic acid, isophthalic acid, terephthalic acid, fumaric acid, maleic acid, adipic acid and succinic acid; succinic acids substituted by alkyl groups of 1 to 20 carbon atoms and alkenyl groups of 2 to 20 carbon atoms such as dodecenylsuccinic acid and octenylsuccinic acid; polyvalent carboxylic acids of trivalent or more such as trimellitic acid and pyromellitic acid, anhydrides of these acids, and alkyl (carbon number: 1 to 3) esters of these acids.

The polyester resins may be prepared, for example, by a polycondensation reaction between an alcohol component and a carboxylic component using an esterification catalyst as required within an inert atmosphere at 180° C. to 250° C.

Preferably, the polyester resin has a softening temperature of 80° C. to 150° C., a glass transition temperature of 40° C. to 75° C., and an acid value of 5 to 40 mgKOH/g.

Colorant

The colorant may be any dyes and pigments etc. used for toners; examples thereof include carbon black, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B and disazoyellow. These may be used alone or in combination of two or more. The amount of the colorant is preferably 1 to 40 parts by mass based on 100 parts by mass of the binder resin, more preferably 3 to 10 parts by mass. The inventive toner may be black toners or color toners.

The inventive toner may be contain the other ingredients such as charge control agents, releasing agents, flowability improvers, conductivity control agents, body pigments, reinforcing fillers such as fiber materials, antioxidants, age resistors, cleaning improvers and magnetic materials.

EXAMPLES

The present invention will be explained with reference to Examples, but to which the present invention should not be construed to be limited. In the descriptions below, all parts and percentages are expressed by mass unless indicated otherwise.

Formulation and Condition of Kneading and Milling Base Toner

Kneading formulations and conditions of kneading and milling (course milling and fine milling) in terms of the first cycle without any recycle toner will be explained in relation to a base toner.

(1) Milled Base Tone 1-0

Resin Production Example 1

A total of 568 parts of polyoxypropylene(2.2)-2,2-bis(4-hydroxyphenyl)propane, 792 parts of polyoxyethylene(2.2)-2,2-bis(4-hydroxyphenyl)propane, 640 parts of terephthahic acid, and 10 parts of tin octylic acid were stirred and allowed to react at 210° C. under nitrogen gas flow. The polymerization degree was pursued with time and the reaction was stopped when the softening temperature came to 110° C., thereby to obtain Resin A. The Resin A had a glass transition temperature of 68° C. and an acid value of 5 mgKOH/g.

Production Example 1 of Milled Base Toner

A total of 100 parts of the Resin A, 3.0 parts of a colorant of copper phthalocyanine blue (FG7351, by Toyo Ink Mfg Co.), and 1.5 parts of a charge control agent (Bontron E-84, by Orient Chemical Industries, Ltd.) were mixed at 1200 rpm using a Henschel mixer (20B, by Mitsui Mining Co.); the resulting mixture was kneaded using a continuous kneader (Buss Ko-Kneader MDK Model 45, Buss Co.) under a condition of feed rate: 10 kg/hr, screw-rotating number: 80 rpm, screw temperature: 40° C., site temperatures of Z1: 90° C., Z2: 70° C., Z3: 70° C., thereby to prepare a kneaded product.

The resulting kneaded product was allowed to cool in air atmosphere, followed by coarsely milling using Rootplex (by Arbein Co.), thereby to prepare a coarsely milled product having a volume average-particle diameter (D50v) of about 500 μm.

Then the coarsely milled product was finely milled using a milling device (IDS-2, by Nippon Pneumatic Mfg. Co.) under a condition of feed rate: 3.5 kg/hr, air pressure: 7.2 kg/cm$^2$, thickness of CC ring: 20 mm, and thickness of OE ring: 10 mm, thereby to prepare a toner of Milled Base Toner 1-0 having a mass average particle diameter of 6.1 μm.

(2) Milled Base Tone 2-0

Resin Production Example 2

A total of 1705 parts of polyoxypropylene(2.2)-2,2-bis(4-hydroxyphenyl)propane, 328 parts of terephthalic acid, 1050 parts of fumaric acid, and 2.5 parts of dibutyltin oxide were inserted into a four-necked 5 L flask, equipped with a nitrogen gas inlet, a dewatering conduct, a stirrer, and a thermocouple, then the mixture was allowed to react at 230° C. for 8 hours, followed by further reacting under a pressure of 8.3 kPa till a pre-determined softening temperature appeared to obtain Resin B.

The resulting Resin B had an acid value of 19 mgKOH/g, a softening temperature of 108° C. and a glass transition temperature of 60° C.

Production Example 2 of Milled Base Toner

A total of 100 parts of Resin B, 5.0 parts of a colorant (dimethylquinacridone, Hostaperm Pink E-WD, by Clariant Co.), and 1.5 parts of a charge control agent (Bontron E-84, by Orient Chemical Industries, Ltd.) were mixed at 1200 rpm using a Henschel mixer (20B, by Mitsui Mining Co.). The resulting mixture was kneaded using a continuous kneader (Buss Ko-Kneader MDK Model 45, Buss Co.) under a condition of feed rate: 10 kg/hr, screw rotating number: 80 rpm, screw temperature: 40° C., site temperatures of Z1: 90° C., Z2: 70° C., Z3: 70° C., thereby to prepare a kneaded product.

The resulting kneaded product was allowed to cool in air atmosphere, followed by coarsely milling using Rootplex (by Arbein Co.), thereby to prepare a coarsely milled product having a volume average-particle diameter (D50v) of about 500 μm.

Then the coarsely milled product was finely milled using a milling device (IDS-2, by Nippon Pneumatic Mfg. Co.) under a condition of feed rate: 1.5 kg/hr, air pressure: 7.2 kg/cm$^2$, thickness of CC ring: 10 mm, and thickness of OE ring: 5 mm, thereby to prepare a toner of Milled Base Toner 2-0 having a mass average particle diameter of 3.3 μm.

(3) Milled Base Tone 3-0

Resin Production Example 3

A total of 735 g of polyoxypropylene(2.2)-2,2-bis(4-hydroxyphenyl)propane, 293 g of polyoxyethylene(2.2)-2,2-bis(4-hydroxyphenyl)propane, 280 g of isophthalic acid, 60 g of isooctenyl succinic acid, 72 g of trimellitic acid, and 2 g of dibutyltin oxide were inserted into a four-necked 3 L glass flask, equipped with a thermometer, a stainless-stirring rod, a flow-down condenser, and a nitrogen gas inlet, then the mixture was allowed to react at 230° C. under nitrogen gas atmosphere of reduced pressure while heating the flask within a mantle heater. The polymerization degree was pursued with time in accordance with ASTM D36-86 and the reaction was stopped when the softening temperature came to 136° C., thereby to obtain Resin C. The Resin C was a light yellow solid, and had a glass transition temperature of 63° C., an acid value of 3.1 mgKOH/g, and a hydroxyl group value of 35.2 mgKOH/g.

Production Example 3 of Milled Base Toner

A total of 100 parts of the Resin C, 3.0 parts of a colorant of copper phthalocyanine blue (FG7351, by Toyo Ink Mfg Co.), and 1.5 parts of a charge control agent (Bontron E-84, by Orient Chemical Industries, Ltd.) were mixed at 1200 rpm using a Henschel mixer (20B, by Mitsui Mining Co.). The resulting mixture was kneaded using a continuous kneader (Buss Ko-Kneader MDK Model 45, Buss Co.) under a condition of feed rate: 10 kg/hr, screw rotating number: 80 rpm, screw temperature: 40° C., site temperatures of Z1: 90° C., Z2: 70° C., Z3: 70° C., thereby to prepare a kneaded product.

The resulting kneaded product was allowed to cool in air atmosphere, followed by coarsely milling using Rootplex (by Arbein Co.), thereby to prepare a coarsely milled product having a volume average-particle diameter (D50v) of about 500 μm.

Then the coarsely milled product was finely milled using a milling device (IDS-2, by Nippon Pneumatic Mfg. Co.) under a condition of feed rate: 2.0 kg/hr, air pressure: 7.2 kg/cm$^2$, thickness of CC ring: 10 mm, and thickness of OE ring: 5 mm, thereby to prepare a toner of Milled Base Toner 3-0 having a mass average particle diameter of 4.3 μm.

Detail of External Additive (1) Hydrophobic Silica 1

H2000 (by Wacker Chemie AG.), surface-treating agent: hexamethyldisilazane (HMDS), average particle diameter: 10 nm (2) Hydrophobic Silica 2

RX-50 (by Degussa Japan Co.), surface-treating agent: hexamethyldisilazane (HMDS), average particle diameter: 40 nm (3) Hydrophobic Silica 3

TS720 (by Cabot Co.), surface-treating agent: silicone oil, average particle diameter: 12 nm (4) Hydrophobic Titanium Oxide 1

JMT-150IB (by Teica Co.), surface-treating agent: isobutyltrimethoxysilane, average particle diameter: 15 nm Example 1

100 parts of Milled Base Toner 1-0 and 0.60 part of Hydrophobic Silica 1 were mixed for 1 minute at 1500 rpm using a Henschel mixer (20B, by Mitsui Mining Co.). The resulting mixture was classified into a primary classified component (referred to as "Base 1-0") having a pre-determined particle diameter distribution and a primary fine powder component (referred to as "Fine Powder 1-0"), using an air classifier (132MP, by Hosokawa Micron Co.). The vane opening angle of the air classifier was 10 degrees and the feed rate was 500 g/min.

The properties of Base 1-0 and Fine Powder 1-0 were as follows:

Base 1-0 mass average particle diameter (D4): 6.6 μm, number average particle diameter (Dn): 5.5 μm, D4/Dn: 1.20

Fine Powder 1-0 mass average particle diameter (D4): 2.8 μm, number average particle diameter (Dn): 2.0 μm, D4/Dn: 1.40, externally added amount of external additive (Hydrophobic Silica 1): 1.19 parts The ingredients of Milled Base Toner 1-0 and Fine Powder 1-0 were mixed in a mass ratio of 0.80 part for the entire ingredients of Milled Base Toner 1-0, in proportional amount as regards the formulation described above, and 0.20 part of Fine Powder 1-0; then the mixture was kneaded, coarsely milled, and finely milled similarly as described above, thereby to prepare Milled Base Toner 1-1.

100 parts of the resulting Milled Base Toner 1-1 and 0.6 part of Hydrophobic Silica 1 were similarly mixed and classified to prepare Base 1-1. 100 parts of the resulting Base 1-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 1-1 (final product).

The mixing and kneading of the fine powder, obtained at the same time, with the Base material was similarly carried out 15 cycles. The internally added amount of external additive in Milled Base Toner 1-15 at 15th cycle was 0.40 part.

The Base 1-15, after being classified, had the following properties.

mass average particle diameter (D4): 6.8 μm, number average particle diameter (Dn): 5.5 μm, D4/Dn: 1.24

100 parts of the resulting Base 1-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 1-15 (final product).

95 parts of Carrier 1 was mixed to 5 parts of Toner 1-1 or Toner 1-15 for 5 minutes using a turbuler mixer to prepare the respective developers.

Ingredients of Carrier 1

| | |
|---|---|
| acrylic resin solution (solid content: 50%) | 21.0 parts |
| guanamine solution (solid content: 70%) | 6.4 parts |
| alumina particles (0.3 μm)*1) | 7.6 parts |
| silicone resin solution (solid content: 23%)*2) | 65.0 parts |
| aminosilane (solid content: 100%)*3) | 0.3 part |
| toluene | 60 parts |
| butyl cellosolve | 60 parts |

*1)resistivity: $10^{14}$ ohm · cm

*2)SR2410, by Dow Corning Toray Silicone Co.

*3)SH6020, by Dow Corning Toray Silicone Co.

The ingredients of Carrier 1 described above were dispersed for 10 minutes using a homomixer to prepare a liquid for coating acrylic-silicone resin blend-film containing alumina particles. The liquid for coating acrylic-silicone resin blend-film was coated and dried on the surface of calcinated ferrite powder ($(MgO)_{1.8}(MnO)_{49.5}(Fe_2O_3)_{48.0}$, average particle diameter: 35 μm) as a core material to a film thickness of 0.15 μm, using Spira Coater (by Okada Seiko Co.). The resulting carrier was calcinated at 150° C. for 1 hour in an electric furnace. After cooling, the bulk of the ferrite powder was loosed by passing through a screen of opening size 106 μm, thereby to prepare Carrier 1.

The thickness of the coating film was measured, using a transmission electron microscope, by way of observing the cross-section of the carrier in particular the coating film on the carrier surface, and averaging the film thickness.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 2

100 parts of Milled Base Toner 1-0 and 1.0 part of Hydrophobic Silica 1 were mixed for 1 minute at 1500 rpm using a Henschel mixer (20B, by Mitsui Mining Co.). The resulting mixture was classified into a primary classified component (referred to as "Base 2-0") having a pre-determined particle diameter distribution and a primary fine powder component (referred to as "Fine Powder 2-0"), using an air classifier (132MP, by Hosokawa Micron Co.). The vane opening angle of the air classifier was 10 degrees and the feed rate was 500 g/min.

The properties of Base 2-0 and Fine Powder 2-0 were as follows:

Base 2-0 mass average particle diameter (D4): 6.4 μm, number average particle diameter (Dn): 5.4 μm, D4/Dn: 1.19

Fine Powder 2-0 mass average particle diameter (D4): 2.6 μm, number average particle diameter (Dn): 2.1 μm, D4/Dn: 1.24, externally added amount of external additive (Hydrophobic Silica 1): 1.98 parts The ingredients of Milled Base Toner 1-0 and Fine Powder 2-0 were mixed in a mass ratio of 0.70 part for the entire ingredients of Milled Base Toner 1-0, in proportional amount as regards the formulation described above, and 0.30 part of Fine Powder 2-0; then the mixture was kneaded, coarsely milled, and finely milled similarly as described above, thereby to prepare Milled Base Toner 2-1.

The internally added amount of external additive in Milled Base Toner 2-1 was 0.59 part.

100 parts of the resulting Milled Base Toner 2-1 and 1.0 part of Hydrophobic Silica 1 were similarly mixed and classified to prepare Base 2-1. 100 parts of the resulting Base 2-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 2-1 (final product).

The mixing and kneading of the fine powder, obtained at the same time, with the Base material was similarly carried out 15 cycles. The internally added amount of external additive in Milled Base Toner 2-15 at 15th cycle was 1.50 parts.

The Base 2-15, after being classified, had the following properties.

mass average particle diameter (D4): 6.8 μm, number average particle diameter (Dn): 5.5 μm, D4/Dn: 1.24

100 parts of the resulting Base 2-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 2-15 (final product).

In a similar manner as Example 1, 95 parts of Carrier 1 was mixed to 5 parts of Toner 2-1 or Toner 2-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 3

100 parts of Milled Base Toner 1-0 and 2.0 parts of Hydrophobic Silica 1 were mixed for 1 minute at 1500 rpm using a Henschel mixer (20B, by Mitsui Mining Co.). The resulting mixture was classified into a primary classified component (referred to as "Base 3-0") having a pre-determined particle diameter distribution and a primary fine powder component (referred to as "Fine Powder 3-0"), using an air classifier (132MP, by Hosokawa Micron Co.). The vane opening angle of the air classifier was 10 degrees and the feed rate was 500 g/min.

The properties of Base 3-0 and Fine Powder 3-0 were as follows:

Base 3-0
mass average particle diameter (D4): 6.5 μm,
number average particle diameter (Dn): 5.4 μm,
D4/Dn: 1.20
Fine Powder 3-0
mass average particle diameter (D4): 2.4 μm,
number average particle diameter (Dn): 2.0 μm,
D4/Dn: 1.20,
externally added amount of external additive (Hydrophobic Silica 1): 3.92 parts The ingredients of Milled Base Toner 1-0 and Fine Powder 3-0 were mixed in a mass ratio of 0.70 part for the entire ingredients of Milled Base Toner 1-0, in proportional amount as regards the formulation described above, and 0.30 part of Fine Powder 3-0; then the mixture was kneaded, coarsely milled, and finely milled similarly as described above, thereby to prepare Milled Base Toner 3-1.

The internally added amount of external additive in Milled Base Toner 3-1 was 1.18 parts.

100 parts of the resulting Milled Base Toner 3-1 and 2.0 parts of Hydrophobic Silica 1 were similarly mixed and classified to prepare Base 3-1. 100 parts of the resulting Base 3-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 3-1 (final product).

The mixing and kneading of the fine powder, obtained at the same time, with the Base material was similarly carried out 15 cycles. The internally added amount of external additive in Milled Base Toner 3-15 at 15th cycle was 2.93 parts.

The Base 3-15, after being classified, had the following properties.

mass average particle diameter (D4): 6.8 μm,
number average particle diameter (Dn): 5.6 μm,
D4/Dn: 1.21

100 parts of the resulting Base 3-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 3-15 (final product).

In a similar manner as Example 1, 95 parts of Carrier 1 was mixed to 5 parts of Toner 3-1 or Toner 3-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 4

100 parts of Milled Base Toner 2-0 and 2.7 parts of Hydrophobic Silica 1 were mixed for 1 minute at 1500 rpm using a Henschel mixer (20B, by Mitsui Mining Co.). The resulting mixture was classified into a primary classified component (referred to as "Base 4-0") having a pre-determined particle diameter distribution and a primary fine powder component (referred to as "Fine Powder 4-0"), using an air classifier (132MP, by Hosokawa Micron Co.). The vane opening angle of the air classifier was 8 degrees and the feed rate was 400 g/min.

The properties of Base 4-0 and Fine Powder 4-0 were as follows:

Base 4-0
mass average particle diameter (D4): 4.5 μm,
number average particle diameter (Dn): 3.9 μm,
D4/Dn: 1.15
Fine Powder 4-0
mass average particle diameter (D4): 1.9 μm,
number average particle diameter (Dn): 1.6 μm,
D4/Dn: 1.18,
externally added amount of external additive (Hydrophobic Silica 1): 5.26 parts The ingredients of Milled Base Toner 2-0 and Fine Powder 4-0 were mixed in a mass ratio of 0.75 part for the entire ingredients of Milled Base Toner 2-0, in proportional amount as regards the formulation described above, and 0.25 part of Fine Powder 4-0; then the mixture was kneaded, coarsely milled, and finely milled similarly as described above, thereby to prepare Milled Base Toner 4-1.

The internally added amount of external additive in Milled Base Toner 4-1 was 1.31 parts.

100 parts of the resulting Milled Base Toner 4-1 and 2.7 parts of Hydrophobic Silica 1 were similarly mixed and classified to prepare Base 4-1. 100 parts of the resulting Base 4-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 4-1 (final product).

The mixing and kneading of the fine powder, obtained at the same time, with the Base material was similarly carried out 15 cycles. The internally added amount of external additive in Milled Base Toner 4-15 at 15th cycle was 2.70 parts.

The Base 4-15, after being classified, had the following properties.

mass average particle diameter (D4): 4.8 μm,
number average particle diameter (Dn): 4.1 μm,
D4/Dn: 1.17

100 parts of the resulting Base 4-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 4-15 (final product).

In a similar manner as Example 1, 95 parts of Carrier 1 was mixed to 5 parts of Toner 4-1 or Toner 4-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 5

100 parts of Milled Base Toner 2-0 and 4.5 parts of Hydrophobic Silica 2 were mixed for 1 minute at 1500 rpm using a Henschel mixer (20B, by Mitsui Mining Co.). The resulting mixture was classified into a primary classified component (referred to as "Base 5-0") having a pre-determined particle diameter distribution and a primary fine powder component (referred to as "Fine Powder 5-0"), using an air classifier (132MP, by Hosokawa Micron Co.). The vane opening angle of the air classifier was 8 degrees and the feed rate was 400 g/min.

The properties of Base 5-0 and Fine Powder 5-0 were as follows:

Base 5-0
mass average particle diameter (D4): 4.4 μm,
number average particle diameter (Dn): 3.8 μm,
D4/Dn: 1.16
Fine Powder 5-0
mass average particle diameter (D4): 1.9 μm,
number average particle diameter (Dn): 1.5 μm,
D4/Dn: 1.27,
externally added amount of external additive (Hydrophobic Silica 2): 8.61 parts The ingredients of Milled Base Toner 2-0 and Fine Powder 5-0 were mixed in a mass ratio of 0.80 part for the entire ingredients of Milled Base Toner 2-0, in proportional amount as regards the formulation described above, and 0.20 part of Fine Powder 5-0; then the mixture was kneaded, coarsely milled, and finely milled similarly as described above, thereby to prepare Milled Base Toner 5-1.

The internally added amount of external additive in Milled Base Toner 5-1 was 1.72 parts.

100 parts of the resulting Milled Base Toner 5-1 and 4.5 parts of Hydrophobic Silica 2 were similarly mixed and classified to prepare Base 5-0. 100 parts of the resulting Base 5-0 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 5-0 (final product).

The mixing and kneading of the fine powder, obtained at the same time, with the Base material was similarly carried out 15 cycles. The internally added amount of external additive in Milled Base Toner 5-15 at 15th cycle was 2.94 parts.

The Base 5-15, after being classified, had the following properties.

mass average particle diameter (D4): 4.6 μm,
number average particle diameter (Dn): 3.9 μm,
D4/Dn: 1.18

100 parts of the resulting Base 5-15 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 5-15 (final product).

In a similar manner as Example 1, 95 parts of Carrier 1 was mixed to 5 parts of Toner 5-1 or Toner 5-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 6

100 parts of Milled Base Toner 2-0 and 2.0 parts of Hydrophobic Silica 2 were mixed for 1 minute at 1500 rpm using a Henschel mixer (20B, by Mitsui Mining Co.). The resulting mixture was classified into a primary classified component (referred to as "Base 6-0") having a pre-determined particle diameter distribution and a primary fine powder component (referred to as "Fine Powder 6-0"), using an air classifier (132MP, by Hosokawa Micron Co.). The vane opening angle of the air classifier was 8 degrees and the feed rate was 400 g/min.

The properties of Base 6-0 and Fine Powder 6-0 were as follows:

Base 6-0
mass average particle diameter (D4): 4.3 μm,
number average particle diameter (Dn): 3.7 μm,
D4/Dn: 1.16
Fine Powder 6-0
mass average particle diameter (D4): 1.8 μm,
number average particle diameter (Dn): 1.5 μm,
D4/Dn: 1.20,
externally added amount of external additive (Hydrophobic Silica 2): 3.92 parts The ingredients of Milled Base Toner 2-0 and Fine Powder 6-0 were mixed in a mass ratio of 0.80 part for the entire ingredients of Milled Base Toner 2-0, in proportional amount as regards the formulation described above, and 0.20 part of Fine Powder 6-0; then the mixture was kneaded, coarsely milled, and finely milled similarly as described above, thereby to prepare Milled Base Toner 6-1.

The internally added amount of external additive in Milled Base Toner 6-1 was 0.39 part.

100 parts of the resulting Milled Base Toner 6-1 and 2.0 parts of Hydrophobic Silica 2 were similarly mixed and classified to prepare Base 6-1. 100 parts of the resulting Base 6-1 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 6-1 (final product).

The mixing and kneading of the fine powder, obtained at the same time, with the Base material was similarly carried out 15 cycles. The internally added amount of external additive in Milled Base Toner 6-15 at 15th cycle was 0.50 part.

The Base 6-15, after being classified, had the following properties.

mass average particle diameter (D4): 4.6 μm,
number average particle diameter (Dn): 3.8 μm,
D4/Dn: 1.21

100 parts of the resulting Base 6-15 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 6-15 (final product).

In a similar manner as Example 1, 95 parts of Carrier 1 was mixed to 5 parts of Toner 6-1 or Toner 6-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 7

100 parts of Milled Base Toner 3-0 and 1.2 parts of Hydrophobic Silica 2 were mixed for 1 minute at 1500 rpm using a Henschel mixer (20B, by Mitsui Mining Co.). The resulting mixture was classified into a primary classified component (referred to as "Base 7-0") having a pre-determined particle diameter distribution and a primary fine powder component (referred to as "Fine Powder 7-0"), using an air classifier (132MP, by Hosokawa Micron Co.). The vane opening angle of the air classifier was 9 degrees and the feed rate was 450 g/min.

The properties of Base 7-0 and Fine Powder 7-0 were as follows:

Base 7-0
mass average particle diameter (D4): 5.5 μm,
number average particle diameter (Dn): 4.8 μm,
D4/Dn: 1.15
Fine Powder 7-0
mass average particle diameter (D4): 2.0 μm,
number average particle diameter (Dn): 1.6 μm,
D4/Dn: 1.25,
externally added amount of external additive (Hydrophobic Silica 2): 2.37 parts 100 parts of the resulting Base 7-0 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 7-0 (final product).

The internally added amount of external additive in Milled Base Toner 7-1 was 0.23 part.

100 parts of the resulting Milled Base Toner 7-1 and 1.2 parts of Hydrophobic Silica 2 were similarly mixed and classified to prepare Base 7-1. 100 parts of the resulting Base 7-1 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 7-1 (final product).

The mixing and kneading of the fine powder, obtained at the same time, with the Base material was similarly carried out 15 cycles. The internally added amount of external additive in Milled Base Toner 7-15 at 15th cycle was 0.30 part.

The Base 7-15, after being classified, had the following properties.

mass average particle diameter (D4): 5.8 μm,
number average particle diameter (Dn): 4.9 μm,
D4/Dn: 1.18

100 parts of the resulting Base 7-15 and 1.0 part of Hydrophobic Silica 2 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 7-15 (final product).

In a similar manner as Example 1, 95 parts of Carrier 1 was mixed to 5 parts of Toner 7-1 or Toner 7-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 8

100 parts of Milled Base Toner 3-0 and 2.0 parts of Hydrophobic Silica 3 were mixed for 1 minute at 1500 rpm using a Henschel mixer (20B, by Mitsui Mining Co.). The resulting mixture was classified into a primary classified component (referred to as "Base 8-0") having a pre-determined particle diameter distribution and a primary fine powder component (referred to as "Fine Powder 8-0"), using an air classifier (132MP, by Hosokawa Micron Co.). The vane opening angle of the air classifier was 9 degrees and the feed rate was 450 g/min.

The properties of Base 8-0 and Fine Powder 8-0 were as follows:

Base 8-0
mass average particle diameter (D4): 5.3 μm,
number average particle diameter (Dn): 4.6 μm,
D4/Dn: 1.15
Fine Powder 8-0
mass average particle diameter (D4): 2.1 μm,
number average particle diameter (Dn): 1.7 μm,
D4/Dn: 1.24,
externally added amount of external additive (Hydrophobic Silica 3): 3.92 parts The ingredients of Milled Base Toner 3-0 and Fine Powder 8-0 were mixed in a mass ratio of 0.80 part for the entire ingredients of Milled Base Toner 3-0, in proportional amount as regards the formulation described above, and 0.20 part of Fine Powder 8-0; then the mixture was kneaded, coarsely milled, and finely milled similarly as described above, thereby to prepare Milled Base Toner 8-1.

The internally added amount of external additive in Milled Base Toner 8-1 was 0.78 part.

100 parts of the resulting Milled Base Toner 8-1 and 2.0 parts of Hydrophobic Silica 3 were similarly mixed and classified to prepare Base 8-1. 100 parts of the resulting Base 8-1 and 1.0 part of Hydrophobic Silica 3 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 8-1 (final product).

The mixing and kneading of the fine powder, obtained at the same time, with the Base material was similarly carried out 15 cycles. The internally added amount of external additive in Milled Base Toner 8-15 at 15th cycle was 1.33 parts.

The Base 8-15, after being classified, had the following properties.

mass average particle diameter (D4): 5.6 μm,
number average particle diameter (Dn): 4.9 μm,
D4/Dn: 1.14

100 parts of the resulting Base 8-15 and 1.0 part of Hydrophobic Silica 3 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 8-15 (final product).

In a similar manner as Example 1, 95 parts of Carrier 1 was mixed to 5 parts of Toner 8-1 or Toner 8-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 9

100 parts of Milled Base Toner 3-0, 0.60 part of Hydrophobic Silica 1, and 0.60 part of hydrophobic titanium oxide were mixed for 1 minute at 1500 rpm using a Henschel mixer (20B, by Mitsui Mining Co.). The resulting mixture was classified into a primary classified component (referred to as "Base 9-0") having a pre-determined particle diameter distribution and a primary fine powder component (referred to as "Fine Powder 9-0"), using an air classifier (132MP, by Hosokawa Micron Co.). The vane opening angle of the air classifier was 10 degrees and the feed rate was 500 g/min.

The properties of Base 9-0 and Fine Powder 9-0 were as follows:

Base 9-0
mass average particle diameter (D4): 5.2 μm,
number average particle diameter (Dn): 4.4 μm,
D4/Dn: 1.18
Fine Powder 9-0
mass average particle diameter (D4): 2.0 μm,
number average particle diameter (Dn): 1.6 μm,
D4/Dn: 1.25,
externally added amount of external additive (Hydrophobic Silica 1): 1.20 parts,
externally added amount of external additive (Hydrophobic Titanium Oxide 1): 0.18 part The ingredients of Milled Base Toner 3-0 and Fine Powder 9-0 were mixed in a mass ratio of 0.80 part for the entire ingredients of Milled Base Toner 3-0, in proportional amount as regards the formulation described above, and 0.20 part of Fine Powder 9-0; then the mixture was kneaded, coarsely milled, and finely milled similarly as described above, thereby to prepare Milled Base Toner 9-1.

The internally added amount of external additive in Milled Base Toner 9-1 was 0.23 part of Hydrophobic Silica 1 and 0.24 part of Hydrophobic Titanium Oxide 1.

100 parts of the resulting Milled Base Toner 9-1, 0.60 part of Hydrophobic Silica 1, and 0.60 part of Hydrophobic Titanium Oxide 1 were similarly mixed and classified to prepare Base 9-1. 100 parts of the resulting Base 9-1, 0.70 part of Hydrophobic Silica 1, and 0.70 part of Hydrophobic Titanium Oxide 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 9-1 (final product).

The mixing and kneading of the fine powder, obtained at the same time, with the Base material was similarly carried out 15 cycles. The internally added amount of external additive in Milled Base Toner 9-15 at 15th cycle was 0.38 part of Hydrophobic Silica 1 and 0.39 part of Hydrophobic Titanium Oxide 1.

The Base 9-15, after being classified, had the following properties.

mass average particle diameter (D4): 5.5 μm,
number average particle diameter (Dn): 4.8 μm,
D4/Dn: 1.15

100 parts of Base 9-15, 0.70 part of Hydrophobic Silica 1, and 0.70 part of Hydrophobic Titanium Oxide 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 9-15 (final product).

In a similar manner as Example 1, 95 parts of Carrier 1 was mixed to 5 parts of Toner 9-1 or Toner 9-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Example 10

100 parts of Milled Base Toner 1-0 and 1.5 parts of Hydrophobic Silica 1 were mixed for 1 minute at 1500 rpm using a Henschel mixer (20B, by Mitsui Mining Co.). The resulting mixture was classified into a primary classified component (referred to as "Base 10-0") having a pre-determined particle diameter distribution and a primary fine powder component (referred to as "Fine Powder 10-0"), using an air classifier (132MP, by Hosokawa Micron Co.). The vane opening angle of the air classifier was 10 degrees and the feed rate was 500 g/min.

The properties of Base 10-0 and Fine Powder 10-0 were as follows:

Base 10-0
mass average particle diameter (D4): 6.5 μm,
number average particle diameter (Dn): 5.5 μm,
D4/Dn: 1.18
Fine Powder 10-0
mass average particle diameter (D4): 2.5 μm,
number average particle diameter (Dn): 2.0 μm,
D4/Dn: 1.25,
externally added amount of external additive (Hydrophobic Silica 1): 2.96 parts The ingredients of Milled Base Toner 1-0 and Fine Powder 10-0 were mixed in a mass ratio of 0.65 part for the entire ingredients of Milled Base Toner 1-0, in proportional amount as regards the formulation described above, and 0.35 part of Fine Powder 10-0; then the mixture was kneaded, coarsely milled, and finely milled similarly as described above, thereby to prepare Milled Base Toner 10-1.

The internally added amount of external additive in Milled Base Toner 10-1 was 1.03 parts.

100 parts of the resulting Milled Base Toner 10-1 and 1.5 parts of Hydrophobic Silica 1 were similarly mixed and classified to prepare Base 10-1. 100 parts of the resulting Base 10-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 10-1 (final product).

The mixing and kneading of the fine powder, obtained at the same time, with the Base material was similarly carried out 5 cycles. The internally added amount of external additive in Milled Base Toner 10-5 at 5th cycle was 2.91 parts.

From the 6th to 15th cycles, the mixing ratio was changed such that the ingredients of Milled Base Toner 1-0 and Fine Powder 10-0 were mixed in a mass ratio of 0.80 part for the entire ingredients of Milled Base Toner 1-0, in proportional amount as regards the formulation described above, and 0.20 part of Fine Powder 10-5, then the mixture was kneaded, coarsely milled, and finely milled similarly as described above, consequently, 15 cycles were carried out in total thereby to prepare Milled Base Toner 10-6.

The Base 10-15, after being classified, had the following properties.

mass average particle diameter (D4): 6.6 μm,
number average particle diameter (Dn): 5.5 μm,
D4/Dn: 1.20

100 parts of the resulting Base 10-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Toner 10-15 (final product).

In a similar manner as Example 1, 95 parts of Carrier 1 was mixed to 5 parts of Toner 10-1 or Toner 10-15 to prepare the respective developers.

The resulting developers were loaded into a developing device of a color copier (imagio NEO C600, by Ricoh Co.) and images were printed. As a result, clear images could be taken without significant change with time even after continuous 100,000 sheets of printing. The contents and the results are shown in Tables 1 and 2.

Comparative Example 1

100 parts of Milled Base Toner 1-0 and 0.3 part of Hydrophobic Silica 1 were mixed for 1 minute at 1500 rpm using a Henschel mixer (20B, by Mitsui Mining Co.). The resulting mixture was classified into a primary classified component (referred to as "Comparative Base 1-0") having a pre-determined particle diameter distribution and a primary fine powder component (referred to as "Comparative Fine Powder 1-0"), using an air classifier (132MP, by Hosokawa Micron Co.). The vane opening angle of the air classifier was 10 degrees and the feed rate was 500 g/min.

The properties of Comparative Base 1-0 and Comparative Fine Powder 1-0 were as follows:

Comparative Base 1-0
mass average particle diameter (D4): 6.5 μm,
number average particle diameter (Dn): 5.5 μm,
D4/Dn: 1.18
Comparative Fine Powder 1-0
mass average particle diameter (D4): 2.6 μm,
number average particle diameter (Dn): 2.1 μm,
D4/Dn: 1.24,
externally added amount of external additive (Hydrophobic Silica 1): 0.60 part The ingredients of Milled Base Toner 1-0 and Comparative Fine Powder 1-0 were mixed in a mass ratio of 0.80 part for the entire ingredients of Milled Base Toner 1-0, in proportional amount as regards the formulation described above, and 0.20 part of Comparative Fine Powder 1-0; then the mixture was kneaded, coarsely milled, and finely milled similarly as described above, thereby to prepare Comparative Milled Base Toner 1-1.

The internally added amount of external additive in Comparative Milled Base Toner 1-1 was 0.11 part.

100 parts of the resulting Comparative Milled Base Toner 1-1 and 0.30 part of Hydrophobic Silica 1 were similarly mixed and classified to prepare Comparative Base 1-1. 100 parts of the resulting Comparative Base 1-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 1-1 (final product).

The mixing and kneading of the fine powder, obtained at the same time, with the Base material was similarly carried out 15 cycles. The internally added amount of external additive in Comparative Milled Base Toner 1-15 at 15th cycle was 0.22 part.

The Comparative Base 1-15, after being classified, had the following properties.

mass average particle diameter (D4): 6.6 μm,
number average particle diameter (Dn): 5.6 μm,
D4/Dn: 1.18

100 parts of the resulting Comparative Base 1-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 1-15 (final product).

In a similar manner as Example 1, 95 parts of Carrier 1 was mixed to 5 parts of Comparative Toner 1-1 or Comparative Toner 1-15 to prepare the respective developers.

The resulting developers were loaded into a developing device of a color copier (imagio NEO C600, by Ricoh Co.) and images were printed. The contents and the results are shown in Tables 1 and 2.

Comparative Example 2

100 parts of Milled Base Toner 1-0 and 1.0 part of Hydrophobic Silica 1 were mixed for 1 minute at 1500 rpm using a Henschel mixer (20B, by Mitsui Mining Co.). The resulting mixture was classified into a primary classified component (referred to as "Comparative Base 2-0") having a pre-determined particle diameter distribution and a primary fine powder component (referred to as "Comparative Fine Powder 2-0"), using an air classifier (132MP, by Hosokawa Micron Co.). The vane opening angle of the air classifier was 10 degrees and the feed rate was 500 g/min.

The properties of Comparative Base 2-0 and Comparative Fine Powder 2-0 were as follows:

Comparative Base 2-0
mass average particle diameter (D4): 6.4 μm,
number average particle diameter (Dn): 5.4 μm,
D4/Dn: 1.19
Comparative Fine Powder 2-0
mass average particle diameter (D4): 2.5 μm,
number average particle diameter (Dn): 2.1 μm,
D4/Dn: 1.24,
externally added amount of external additive (Hydrophobic Silica 1): 1.98 parts The ingredients of Milled Base Toner 1-0 and Comparative Fine Powder 2-0 were mixed in a mass ratio of 0.9 part for the entire ingredients of Milled Base Toner 1-0, in proportional amount as regards the formulation described above, and 0.10 part of Comparative Fine Powder 2-0; then the mixture was kneaded, coarsely milled, and finely milled similarly as described above, thereby to prepare Comparative Milled Base Toner 2-1.

The internally added amount of external additive in Comparative Milled Base Toner 2-1 was 0.17 part.

100 parts of the resulting Comparative Milled Base Toner 2-1 and 1.0 part of Hydrophobic Silica 1 were similarly mixed and classified to prepare Comparative Base 2-1. 100 parts of the resulting Comparative Base 2-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 2-1 (final product).

The mixing and kneading of the fine powder, obtained at the same time, with the Base material was similarly carried out 15 cycles. The internally added amount of external additive in Comparative Milled Base Toner 2-15 at 15th cycle was 0.25 part.

The Comparative Base 2-15, after being classified, had the following properties.

mass average particle diameter (D4): 6.4 μm,
number average particle diameter (Dn): 5.4 μm,
D4/Dn: 1.19

100 parts of the resulting Comparative Base 2-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 2-15 (final product).

In a similar manner as Example 1, 95 parts of Carrier 1 was mixed to 5 parts of Comparative Toner 2-1 or Comparative Toner 2-15 to prepare the respective developers.

The resulting developers were loaded into a developing device of a color copier (imagio NEO C600, by Ricoh Co.) and images were printed. The contents and the results are shown in Tables 1 and 2.

Comparative Example 3

100 parts of Milled Base Toner 1-0 and 5.0 parts of Hydrophobic Silica 1 were mixed for 1 minute at 1500 rpm using a Henschel mixer (20B, by Mitsui Mining Co.). The resulting mixture was classified into a primary classified component (referred to as "Comparative Base 3-0") having a pre-determined particle diameter distribution and a primary fine powder component (referred to as "Comparative Fine Powder 3-0"), using an air classifier (132MP, by Hosokawa Micron Co.). The vane opening angle of the air classifier was 10 degrees and the feed rate was 500 g/min.

The properties of Comparative Base 3-0 and Comparative Fine Powder 3-0 were as follows:

Comparative Base 3-0
mass average particle diameter (D4): 6.4 μm,
number average particle diameter (Dn): 5.4 μm,
D4/Dn: 1.19
Comparative Fine Powder 3-0
mass average particle diameter (D4): 2.4 μm,
number average particle diameter (Dn): 2.0 μm,
D4/Dn: 1.20,
externally added amount of external additive (Hydrophobic Silica 1): 9.52 parts The ingredients of Milled Base Toner 1-0 and Comparative Fine Powder 3-0 were mixed in a mass ratio of 0.80 part for the entire ingredients of Milled Base Toner 1-0, in proportional amount as regards the formulation described above, and 0.20 part of Comparative Fine Powder 3-0; then the mixture was kneaded, coarsely milled, and finely milled similarly as described above, thereby to prepare Comparative Milled Base Toner 3-1.

The internally added amount of external additive in Comparative Milled Base Toner 3-1 was 1.90 parts.

100 parts of the resulting Comparative Milled Base Toner 3-1 and 5.0 parts of Hydrophobic Silica 1 were similarly mixed and classified to prepare Comparative Base 3-1. 100 parts of the resulting Comparative Base 3-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 3-1 (final product).

The mixing and kneading of the fine powder, obtained at the same time, with the Base material was similarly carried out 15 cycles. The internally added amount of external additive in Comparative Milled Base Toner 3-15 at 15th cycle was 3.33 parts.

The Comparative Base 3-15, after being classified, had the following properties.

mass average particle diameter (D4): 7.5 μm,
number average particle diameter (Dn): 6.0 μm,
D4/Dn: 1.25

100 parts of the resulting Comparative Base 3-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 3-15 (final product).

In a similar manner as Example 1, 95 parts of Carrier 1 was mixed to 5 parts of Comparative Toner 3-1 or Comparative Toner 3-15 to prepare the respective developers.

The resulting developers were loaded into a developing device of a color copier (imagio NEO C600, by Ricoh Co.) and images were printed. The contents and the results are shown in Tables 1 and 2.

Comparative Example 4

100 parts of Milled Base Toner 1-0 and 1.5 parts of Hydrophobic Silica 1 were mixed for 1 minute at 1500 rpm using a Henschel mixer (20B, by Mitsui Mining Co.). The resulting mixture was classified into a primary classified component (referred to as "Comparative Base 4-0") having a pre-determined particle diameter distribution and a primary fine powder component (referred to as "Comparative Fine Powder 4-0"), using an air classifier (132MP, by Hosokawa Micron Co.). The vane opening angle of the air classifier was 10 degrees and the feed rate was 500 g/min.

The properties of Comparative Base 4-0 and Comparative Fine Powder 4-0 were as follows:

Comparative Base 4-0
mass average particle diameter (D4): 6.3 μm,
number average particle diameter (Dn): 5.4 μm,
D4/Dn: 1.17
Comparative Fine Powder 4-0
mass average particle diameter (D4): 2.5 μm,
number average particle diameter (Dn): 2.0 μm,
D4/Dn: 1.25,
externally added amount of external additive (Hydrophobic Silica 1): 2.96 parts The ingredients of Milled Base Toner 1-0 and Comparative Fine Powder 4-0 were mixed in a mass ratio of 0.95 part for the entire ingredients of Milled Base Toner 1-0, in proportional amount as regards the formulation described above, and 0.05 part of Comparative Fine Powder 4-0; then the mixture was kneaded, coarsely milled, and finely milled similarly as described above, thereby to prepare Comparative Milled Base Toner 4-1.

The internally added amount of external additive in Comparative Milled Base Toner 4-1 was 0.15 part.

100 parts of the resulting Comparative Milled Base Toner 4-1 and 1.5 parts of Hydrophobic Silica 1 were similarly mixed and classified to prepare Comparative Base 4-1. 100 parts of the resulting Comparative Base 4-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 4-1 (final product).

The mixing and kneading of the fine powder, obtained at the same time, with the Base material was similarly carried out 15 cycles. The internally added amount of external additive in Comparative Milled Base Toner 4-15 at 15th cycle was 0.22 part.

The Comparative Base 4-15, after being classified, had the following properties.

mass average particle diameter (D4): 6.4 μm,
number average particle diameter (Dn): 5.4 μm,
D4/Dn: 1.19

100 parts of the resulting Comparative Base 4-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 4-15 (final product).

In a similar manner as Example 1, 95 parts of Carrier 1 was mixed to 5 parts of Comparative Toner 4-1 or Comparative Toner 4-15 to prepare the respective developers.

The resulting developers were loaded into a developing device of a color copier (imagio NEO C600, by Ricoh Co.) and images were printed. The contents and the results are shown in Tables 1 and 2.

Comparative Example 5

100 parts of Milled Base Toner 1-0 and 1.5 parts of Hydrophobic Silica 1 were mixed for 1 minute at 1500 rpm using a Henschel mixer (20B, by Mitsui Mining Co.). The resulting mixture was classified into a primary classified component (referred to as "Comparative Base 5-0") having a pre-determined particle diameter distribution and a primary fine powder component (referred to as "Comparative Fine Powder 5-0"), using an air classifier (132MP, by Hosokawa Micron Co.). The vane opening angle of the air classifier was 10 degrees and the feed rate was 500 g/min.

The properties of Comparative Base 5-0 and Comparative Fine Powder 5-0 were as follows:

Comparative Base 5-0
mass average particle diameter (D4): 6.3 μm,
number average particle diameter (Dn): 5.4 μm,
D4/Dn: 1.17
Comparative Fine Powder 5-0
mass average particle diameter (D4): 2.4 μm,
number average particle diameter (Dn): 2.0 μm,
D4/Dn: 1.20,
externally added amount of external additive (Hydrophobic Silica 1): 2.96 parts The ingredients of Milled Base Toner 1-0 and Comparative Fine Powder 5-0 were mixed in a mass ratio of 0.65 part for the entire ingredients of Milled Base Toner 1-0, in proportional amount as regards the formulation described above, and 0.35 part of Comparative Fine Powder 5-0; then the mixture was kneaded, coarsely milled, and finely milled similarly as described above, thereby to prepare Comparative Milled Base Toner 5-1.

The internally added amount of external additive in Comparative Milled Base Toner 5-1 was 1.03 parts.

100 parts of the resulting Comparative Milled Base Toner 5-1 and 1.5 parts of Hydrophobic Silica 1 were similarly mixed and classified to prepare Comparative Base 5-1. 100 parts of the resulting Comparative Base 5-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 5-1 (final product).

The mixing and kneading of the fine powder, obtained at the same time, with the Base material was similarly carried out 15 cycles. The internally added amount of external additive in Comparative Milled Base Toner 5-15 at 15th cycle was 3.48 parts.

The Comparative Base 5-15, after being classified, had the following properties.

mass average particle diameter (D4): 7.8 μm,
number average particle diameter (Dn): 6.3 μm,
D4/Dn: 1.24

100 parts of the resulting Comparative Base 5-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 5-15 (final product).

In a similar manner as Example 1, 95 parts of Carrier 1 was mixed to 5 parts of Comparative Toner 5-1 or Comparative Toner 5-15 to prepare the respective developers.

The resulting developers were loaded into a developing device of a color copier (imagio NEO C600, by Ricoh Co.) and images were printed. The contents and the results are shown in Tables 1 and 2.

Comparative Example 6

100 parts of Milled Base Toner 1-0 and 3.0 parts of Hydrophobic Silica 1 were mixed for 1 minute at 1500 rpm using a Henschel mixer (20B, by Mitsui Mining Co.). The resulting mixture was classified into a primary classified component (referred to as "Comparative Base 6-0") having a pre-determined particle diameter distribution and a primary fine powder component (referred to as "Comparative Fine Powder 6-0"), using an air classifier (132MP, by Hosokawa Micron Co.). The vane opening angle of the air classifier was 10 degrees and the feed rate was 500 g/min.

The properties of Comparative Base 6-0 and Comparative Fine Powder 6-0 were as follows:

Comparative Base 6-0
mass average particle diameter (D4): 6.5 μm,
number average particle diameter (Dn): 5.6 μm,
D4/Dn: 1.16
Comparative Fine Powder 6-0
mass average particle diameter (D4): 2.3 μm,
number average particle diameter (Dn): 1.9 μm,
D4/Dn: 1.21,
externally added amount of external additive (Hydrophobic Silica 1): 5.83 parts The ingredients of Milled Base Toner 1-0 and Comparative Fine Powder 6-0 were mixed in a mass ratio of 0.74 part for the entire ingredients of Milled Base Toner 1-0, in proportional amount as regards the formulation described above, and 0.26 part of Comparative Fine Powder 6-0; then the mixture was kneaded, coarsely milled, and finely milled similarly as described above, thereby to prepare Comparative Milled Base Toner 6-1.

The internally added amount of external additive in Comparative Milled Base Toner 6-1 was 1.51 parts.

100 parts of the resulting Comparative Milled Base Toner 6-1 and 3.0 parts of Hydrophobic Silica 1 were similarly mixed and classified to prepare Comparative Base 6-1. 100 parts of the resulting Comparative Base 6-1 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 6-1 (final product).

The mixing and kneading of the fine powder, obtained at the same time, with the Base material was similarly carried out 15 cycles. The internally added amount of external additive in Comparative Milled Base Toner 6-15 at 15th cycle was 3.25 parts.

The Comparative Base 6-15, after being classified, had the following properties.

mass average particle diameter (D4): 7.5 μm, number average particle diameter (Dn): 6.0 μm, D4/Dn: 1.25

100 parts of the resulting Comparative Base 6-15 and 1.0 part of Hydrophobic Silica 1 were mixed for 3 minutes at 1800 rpm using a Henschel mixer (20B, by Mitsui Mining Co.), then the mixture was passed through an ultrasonic sieving apparatus equipped with a 26 μm mesh screen thereby to prepare Comparative Toner 6-15 (final product).

In a similar manner as Example 1, 95 parts of Carrier 1 was mixed to 5 parts of Comparative Toner 6-1 or Comparative Toner 6-15 to prepare the respective developers.

The resulting developers were loaded into a developing device of a color copier (imagio NEO C600, by Ricoh Co.) and images were printed. The contents and the results are shown in Tables 1 and 2.

Measuring Procedure (1) Measurement of Mass Average Particle Diameter (D4) and Number Average Particle Diameter (Dn) of Toner The particle size distribution of toner particles was measured using Coulter Counter TA-II (by Beckman Coulter, Inc.). The specific measuring procedures were as follows. Initially, 0.1 to 5 mL of a surfactant of alkylbenzene sulfonate was added as a dispersant into 100 to 150 mL of an aqueous electrolyte solution. The electrolyte solution was 1% NaCl aqueous solution, which was prepared from 1st grade of sodium chloride and used for ISOTON-II (by Beckman Coulter, Inc.). A toner sample of 2 to 20 mg was added to the electrolyte solution, which was then ultrasonically dispersed for 1 to 3 minutes using a ultrasonic dispersing device, then the mass and number of the toner particles were measured by use of the Coulter counter TA-II with an aperture of 50 μm to calculate the mass distribution and the number distribution, from which the mass average particle diameter (D4) and the number average particle diameter (Dn) of toner sample were determined.

In order to measure particles having a particle diameter (Pd) of no less than 1.59 μm to less than 32.00 μm, thirteen channels were used for 1.59 μm≦Pd<2.00 μm, 2.00 μm≦Pd<2.52 μm, 2.52 μm≦Pd<3.17 μm, 3.17 μm≦Pd<4.00 μm, 4.00 μm≦Pd<5.04 μm, 5.04 μm≦Pd<6.35 μm, 6.35 μm≦Pd<8.00 μm, 8.00 μm≦Pd<10.08 μm, 10.08 μm≦Pd<12.70 μm, 12.70 μm≦Pd<16.00 μm, 16.00 μm≦Pd<20.20 μm, 20.20 μm≦Pd<25.40 μm and 25.40 μm≦Pd<32.00 μm.

The analysis software was Coulter Multitizer Accucomp version 1.19 (by Beckman Coulter, Inc.).

(2) Measurement of Internally-Added External-Additive Amount (i) The amount of internally-added external-additive in toners was determined by way of measuring the amount of metal elements such as Si and Ti by use of a fluorescent X-ray spectroscopy (RIX3000, automatic fluorescent X-ray analyzer, by Rigaku Co.) and calculating the amount of metal oxide fine particles such as $SiO_2$ and $TiO_2$ in toners. In the measurement, milled base toners were used and made respectively into a disc tablet of 40 mm diameter by pressing the toner of 3.0±0.1 g at 6 ton/cm$^2$ for 30 seconds.

(ii) The amount of external-additive depositing on the surface of toners was determined by way of measuring in terms of entire toners the amount of metal elements such as Si and Ti by use of a fluorescent X-ray spectroscopy (RIX3000, automatic fluorescent X-ray analyzer, by Rigaku Co.) and calculating the amount of metal oxide fine particles such as $SiO_2$ and $TiO_2$; then the amount of internally-added external-additive of metal oxide fine particles determined in (i) was subtracted from the amount of entire toners thereby to determine the externally added external-additive. The pellets for measurement were prepared in the same manner as (i).

TABLE 1

| | | External Additive | | | | |
|---|---|---|---|---|---|---|
| | Milled Base Toner | ingredient | initially added amount (part) | 1st cycle internal amount (part): X | 15th cycle internal amount (part): X | ratio B |
| Ex. 1 | 1 | Hydrophobic Silica 1 | 0.6 | 0.23 | 0.40 | 0.20 |
| Ex. 2 | 1 | Hydrophobic Silica 1 | 1.0 | 0.59 | 1.50 | 0.30 |
| Ex. 3 | 1 | Hydrophobic Silica 1 | 2.0 | 1.18 | 2.93 | 0.30 |
| Ex. 4 | 2 | Hydrophobic Silica 1 | 2.7 | 1.31 | 2.70 | 0.25 |
| Ex. 5 | 2 | Hydrophobic Silica 2 | 4.5 | 1.72 | 2.94 | 0.20 |
| Ex. 6 | 2 | Hydrophobic Silica 2 | 2.0 | 0.39 | 0.50 | 0.10 |
| Ex. 7 | 3 | Hydrophobic Silica 2 | 1.1 | 0.23 | 0.30 | 0.10 |
| Ex. 8 | 3 | Hydrophobic Silica 3 | 2.0 | 0.78 | 1.33 | 0.20 |
| Ex. 9 | 3 | Hydrophobic Silica 1 | 0.6 | 0.23 | 0.38 | 0.20 |
| | | Hydrophobic TiO 1 | 0.6 | 0.24 | 0.39 | |
| Ex. 10 | 1 | Hydrophobic Silica 1 | 1.5 | 1.03 | — | 0.35*1 |
| | | | | — | 1.00 | 0.20*2 |
| Com. Ex. 1 | 1 | Hydrophobic Silica 1 | 0.3 | 0.11 | 0.22 | 0.20 |
| Com. Ex. 2 | 1 | Hydrophobic Silica 1 | 1.0 | 0.17 | 0.25 | 0.10 |
| Com. Ex. 3 | 1 | Hydrophobic Silica 1 | 5.0 | 1.90 | 3.33 | 0.20 |
| Com. Ex. 4 | 1 | Hydrophobic Silica 1 | 1.5 | 0.15 | 0.22 | 0.05 |
| Com. Ex. 5 | 1 | Hydrophobic Silica 1 | 1.5 | 1.03 | 3.48 | 0.35 |
| Com. Ex. 6 | 1 | Hydrophobic Silica 1 | 3.0 | 1.51 | 3.25 | 0.26 |

TABLE 1-continued

| | Toner Properties (initial) | | | Toner Properties (after 15th cycle) | | | External Additive after Classification | |
|---|---|---|---|---|---|---|---|---|
| | D4 (μm) | Dn (μm) | D4/Dn | D4 (μm) | Dn (μm) | D4/Dn | ingredient | amount |
| Ex. 1 | 6.6 | 5.5 | 1.20 | 6.8 | 5.5 | 1.24 | HP Silica 1 | 1.0 |
| Ex. 2 | 6.4 | 5.4 | 1.19 | 6.5 | 5.5 | 1.18 | HP Silica 1 | 1.0 |
| Ex. 3 | 6.5 | 5.4 | 1.20 | 6.8 | 5.6 | 1.21 | HP Silica 1 | 1.0 |
| Ex. 4 | 4.5 | 3.9 | 1.15 | 4.8 | 4.1 | 1.17 | HP Silica 1 | 1.0 |
| Ex. 5 | 4.4 | 3.8 | 1.16 | 4.6 | 3.9 | 1.18 | HP Silica 2 | 1.0 |
| Ex. 6 | 4.3 | 3.7 | 1.16 | 4.6 | 3.8 | 1.21 | HP Silica 2 | 1.0 |
| Ex. 7 | 5.5 | 4.8 | 1.15 | 5.8 | 4.9 | 1.18 | HP Silica 2 | 1.0 |
| Ex. 8 | 5.3 | 4.6 | 1.15 | 5.6 | 4.9 | 1.14 | HP Silica 3 | 1.0 |
| Ex. 9 | 5.2 | 4.4 | 1.18 | 5.5 | 4.8 | 1.15 | HP Silica 1 | 0.7 |
| | | | | | | | HP TiO 1 | 0.7 |
| Ex. 10 | 6.5 | 5.5 | 1.18 | — | — | — | HP Silica 1 | 1.0 |
| | — | — | — | 6.6 | 5.5 | 1.20 | | |
| Com. Ex. 1 | 6.5 | 5.5 | 1.18 | 6.6 | 5.6 | 1.18 | HP Silica 1 | 1.0 |
| Com. Ex. 2 | 6.4 | 5.4 | 1.19 | 6.4 | 5.4 | 1.19 | HP Silica 1 | 1.0 |
| Com. Ex. 3 | 6.5 | 5.5 | 1.18 | 7.5 | 6.0 | 1.25 | HP Silica 1 | 1.0 |
| Com. Ex. 4 | 6.3 | 5.4 | 1.17 | 6.4 | 5.4 | 1.19 | HP Silica 1 | 1.0 |
| Com. Ex. 5 | 6.3 | 5.4 | 1.17 | 7.8 | 6.3 | 1.24 | HP Silica 1 | 1.0 |
| Com. Ex. 6 | 6.5 | 5.6 | 1.16 | 7.5 | 6.0 | 1.25 | HP Silica 1 | 1.0 |

*[1]till 5th cycle
*[2]after 5th cycle
HP: hydrophobic
TiO: titanium oxide

TABLE 2

| | | Developer Properties | | | | | | | |
|---|---|---|---|---|---|---|---|---|---|
| | | charge amount of developer (-μc/g) | | concentration of toner (% by mass) | | toner filming | BGS | | |
| | toner | initial | after 100000 | initial | after 100000 | after 100000 | after 100000 | Remark | Total Evaluation |
| Ex. 1 | T1-1 | 30 | 28 | 5.0 | 4.9 | non | non | | A |
| | T1-15 | 32 | 31 | 5.0 | 4.8 | non | non | | |
| Ex. 2 | T2-1 | 33 | 30 | 5.0 | 5.2 | non | non | | A |
| | T2-15 | 34 | 30 | 5.0 | 5.3 | non | non | | |
| Ex. 3 | T3-1 | 34 | 31 | 5.0 | 5.0 | non | non | | A |
| | T3-15 | 35 | 32 | 5.0 | 4.9 | non | non | | |
| Ex. 4 | T4-1 | 43 | 40 | 5.0 | 4.9 | non | non | | A |
| | T4-15 | 44 | 42 | 5.0 | 5.1 | non | non | | |
| Ex. 5 | T5-1 | 41 | 38 | 5.0 | 5.1 | non | non | | A |
| | T5-15 | 42 | 39 | 5.0 | 5.3 | non | non | | |
| Ex. 6 | T6-1 | 44 | 42 | 5.0 | 5.2 | non | non | | A |
| | T6-15 | 42 | 40 | 5.0 | 5.0 | non | non | | |
| Ex. 7 | T7-1 | 37 | 35 | 5.0 | 4.9 | non | non | | A |
| | T7-15 | 38 | 35 | 5.0 | 4.8 | non | non | | |
| Ex. 8 | T8-1 | 36 | 34 | 5.0 | 5.3 | non | non | | A |
| | T8-15 | 37 | 34 | 5.0 | 5.2 | non | non | | |
| Ex. 9 | T9-1 | 33 | 30 | 5.0 | 4.9 | non | non | | A |
| | T9-15 | 31 | 29 | 5.0 | 4.8 | non | non | | |
| Ex. 10 | T10-1 | 31 | 29 | 5.0 | 4.9 | non | non | | A |
| | T10-15 | 33 | 30 | 5.0 | 4.8 | non | non | | |
| Com. Ex. 1 | CT 1-1 | 32 | 15 | 5.0 | 4.4 | non | occur | | B |
| | CT 1-15 | 34 | 30 | 5.0 | 4.9 | non | non | | |
| Com. Ex. 2 | CT 2-1 | 33 | 14 | 5.0 | 4.3 | non | occur | | B |
| | CT 2-15 | 34 | 31 | 5.0 | 4.9 | non | non | | |
| Com. Ex. 3 | CT 3-1 | 33 | 30 | 5.0 | 4.8 | non | non | | B |
| | CT 3-15 | 31 | 29 | 5.0 | 5.1 | occur | non | * | |
| Com. Ex. 4 | CT 4-1 | 31 | 15 | 5.0 | 4.4 | non | occur | | B |
| | CT 4-15 | 33 | 31 | 5.0 | 4.8 | non | non | | |
| Com. Ex. 5 | CT 5-1 | 30 | 29 | 5.0 | 5.0 | non | non | | B |
| | CT 5-15 | 32 | 30 | 5.0 | 5.1 | occur | non | * | |
| Com. Ex. 6 | CT 6-1 | 31 | 28 | 5.0 | 5.3 | non | non | | B |
| | CT 6-15 | 34 | 31 | 5.0 | 4.9 | occur | non | * | |

T: Toner
CT: Comparative Toner
after 100000: after 100000 sheets of printing
BGS: background smear
*: degradation of toner-milling ability

What is claimed is:

1. A method for producing a toner, comprising:

kneading toner ingredients to prepare a toner composition that comprises a binder resin, milling the toner composition to prepare a powder, pre-externally adding at least a part of an external additive to the powder following the milling, to prepare a mixture, classifying the mixture to separate a fine powder component out of a pre-determined particle diameter distribution and provide a toner base, recycling the fine powder component into the kneading step, and post-externally adding an external additive to the toner base, within a pre-determined particle diameter distribution, wherein the internally added amount X of the external additive in the toner is regulated within a range of 0.2 part by mass to 3.0 parts by mass based on 100 parts by mass of the toner base.

2. The method for producing a toner according to claim 1, wherein the internally added amount X of the external additive in the toner is controlled by the amount A of the external additive in the pre-externally adding step and the ratio B between the amount of the fine powder component and the amount of the toner composition without recycled fine powder component in the recycling step;

wherein the ratio B is defined as below:

ratio $B$=recycled fine powder component/(recycled fine powder component+toner composition without recycled fine powder component).

3. The method for producing a toner according to claim 1, wherein the amount A of the external additive in the pre-externally adding step, and the ratio B between the amount of the fine powder component in the recycling step and the amount of the toner composition without recycled fine powder component (ratio B=recycled fine powder component/(recycled fine powder component+toner composition without recycled fine powder component)) satisfy the relation expressed by Equations (1), (2) and (3)

$$0.2 \leqq A \leqq 4.5 \quad (1)$$

$$0.1 \leqq B \leqq 0.3 \quad (2)$$

$$-0.5B+1.8 \leqq A \leqq -2.5B+9.5 \quad (3).$$

4. The method for producing a toner according to claim 2 or 3, wherein the amount A and the ratio B are constant in relation to recycle times, and the internally added amount X of the external additive converges to a certain level;

wherein recycle times is the number of times toner fines are recycled into fresh toner materials.

5. The method for producing a toner according to claim 2 or 3, wherein the amount A and the ratio B are variable in relation to recycle times, and are selected so as to regulate the internally added amount X of the external additive within a range of 0.2 part by mass to 3.0 parts by mass based on 100 parts by mass of the toner ingredients, excepting the externally added amount of the external additive;

wherein recycle times is the number of times toner fines are recycled into fresh toner materials.

* * * * *